US006108596A

United States Patent [19]

Beike

[11] Patent Number: 6,108,596

[45] Date of Patent: Aug. 22, 2000

[54] PROCESS AND DEVICE FOR THE CONTROL AND/OR REGULATION OF WAGON BODY TILT SYSTEMS

[75] Inventor: Johannes Beike, Unterlüsse, Germany

[73] Assignee: TZN Forschungs-und Entwicklungszentrum, Unterluss, Germany

[21] Appl. No.: 09/027,908

[22] Filed: Feb. 23, 1998

[30] Foreign Application Priority Data

Feb. 22, 1997 [DE] Germany ..... 197 07 174
Dec. 2, 1997 [DE] Germany ..... 197 53 355

[51] Int. Cl.[7] ..... G05D 3/00; G06F 7/00

[52] U.S. Cl. ..... 701/19; 701/20; 104/164; 105/1.4; 105/201; 246/182 B; 246/182 C; 246/187 B

[58] Field of Search ..... 701/19, 20, 70, 701/72; 246/187 B, 170, 182 B, 182 C; 105/1.4, 201, 199.2; 104/164

[56] References Cited

U.S. PATENT DOCUMENTS 4,023,753 5/1977 Dobler ..... 246/5
4,123,023 10/1978 Nelson ..... 246/182 B
4,270,716 6/1981 Anderson ..... 246/182 B
4,279,395 7/1981 Boggio et al. ..... 246/182 R
4,302,811 11/1981 McElhenny ..... 701/20

FOREIGN PATENT DOCUMENTS 0 684 150 A 11/1995 European Pat. Off. .
0 713 817 A 5/1996 European Pat. Off. .

*Primary Examiner*—William A. Cuchlinski, Jr.
*Assistant Examiner*—Yonel Beaulieu
*Attorney, Agent, or Firm*—Venable; George Spencer; Norman N. Kunitz

[57] ABSTRACT

A process and a device for the control and/or regulation of a wagon body tilt system (1) for a railed vehicle, e.g., a train. Limit values with respect to comfort are taken into consideration for this purpose. In an equivalent way, these limit values preset a comfort scale for a rail camber or tilt ($\phi_c$) as desired tilt values ($\phi_{desired}$, $\phi_{des.\ Speed}$, $\phi_{des.\ accel.}$) for the control and/or regulation of a wagon body (2) as relevant value based on the system limits and permit a subsequent regulation within the adjustment system (4) of the wagon body (2) only within these limits. If at least one limit value for comfort and/or parameters describing the system is exceeded, these desired tilt values ($\phi_{desired}$, $\phi_{des.\ speed}$, $\phi_{des.\ accel.}$) are then adapted by taking into account this at least one exceeded limit value and are converted to adapted desired tilt values ($\phi'_{desired}$, $\phi'_{des.\ speed}$, $\phi'_{des.\ accel.}$) and used to adjust the wagon body tilt systems (1).

18 Claims, 4 Drawing Sheets

PROCESS AND DEVICE FOR THE CONTROL AND/OR REGULATION OF WAGON BODY TILT SYSTEMS

REFERENCE TO RELATED APPLICATIONS

This application claims the priority of German applications Serial No. 197 07 174.0, filed Feb. 22, 1997 and Serial No. 197 53 355.8, filed Dec. 2, 1997, which are incorporated herein by reference.

This application is related to concurrently filed U.S. patent application Ser. No. (Attorney Docket TZN 0021) which corresponds to German Patent application No. DE 1970175, filed Feb. 22, 1997, and which is incorporated herein by reference.

BACKGROUND OF THE INVENTION

The invention concerns a process and a device for the control and/or regulation of a wagon body tilt system for rail vehicles, used to determine the tilt values for adjusting the wagon body tilt system.

Given the increasing need for mobility, the rail-bound passenger transport can assume an important role only if the travel time is shortened considerably in addition to increasing the transport capacity. This means an increase in the speed for these vehicles. The tracks are not designed for travel at higher speeds, in particular during transit around a curve. Thus, an increase in the speed when traveling through curves results in an increase in the transverse acceleration in the wagon, which in turn results in stress on the passengers.

A plurality of processes and devices acting passively or actively upon the rail vehicle itself or parts thereof are available to counteract these interfering transverse accelerations. For an active effect, the tilting of the wagon body of a rail vehicle is adjusted or changed during the curve transit, that is to say relative to the direction of gravity or relative to the horizontally extending ground surface. For a passive effect, the wagon body is tilted by making use of the rocking motion of the wagon body.

An active process and an associated device for regulating the tilt of a vehicle wagon body is described in German published patent Application No. DE 44 16 586 A1. In that case, all movement values for a rail-bound vehicle are detected or collected and are taken into consideration for regulating the tilt, meaning the turning of the wagon body around its longitudinal or roll axis. There, the movement values are measured at the same location on the wagon body where these values are to be compensated and adjusted.

A device for controlling a tilt arrangement is known from German published patent Application No. DE 27 05 221 A1. With this arrangement, the yaw angle speed and the driving speed are also measured, are converted to a value for a share in the transverse acceleration, and are transmitted as control signal to a tilt arrangement. Owing to the fact that further reference values such as the wagon body mass are not taken into account, an overregulating of the tilt arrangement can occur in this case.

A combination regulation and control system is described in the International Patent Document No. WO 96/02027. The regulation system disclosed therein uses the tilt angle of the wagon body as a relevant value for the effective transverse acceleration. In this case, the tilt angle for the wagon body is obtained from the centrifugal acceleration in the horizontal plane. A preliminary adjustment of the wagon body tilt is made with a pilot control device, e.g. an electronic precontrol and with the help of a variance comparison. The pilot control suggested for the increase in the dynamic relieves the regulating circuit, but is not coordinated with the tilt system/tilt device itself. An unintended jump in the preliminary adjustment can be followed by an oversteering/overregulating of the wagon body tilt.

Tilt values that realize a regulation or control are determined for all existing solutions.

It is the object of the present invention to provide a process for adjusting the tilt of a rail vehicle, which presents the best possible way to ensure comfort and/or safety during the driving operation. It is furthermore the object to provide a device for implementing this process.

SUMMARY OF THE INVENTION

The above object is achieved according to the present invention by a process for determining tilt values for the control and/or regulation of wagon body tilt systems for a rail vehicle, comprising the steps of: providing desired tilt values for at least one tilt parameter of the vehicle; determining if, based on the provided desired tilt values, at least one limit value for a comfort parameter and parameters describing the system is exceeded; if at least one said limit value is exceeded, varying and converting the desired tilt values, taking the at least one limit value into consideration, to adapted desired tilt values to be used for the adjustment of the wagon body tilt system.

The solution according to the invention in this case seizes upon the idea of considering limit values with respect to comfort. In an equivalent way, these limit values predetermine a comfort scale for a rail camber or banking according to CEN/TC 256 (EC Committee for Railroad Standards) as desired tilt values for the control or regulation of a wagon body as relevant values according to the system limits, and permit a subsequent regulation within a wagon body adjustment system to take place only within these limits. If at least one limit value for comfort and/or parameters describing the system were to be exceeded, these desired tilt values are then adjusted, by taking into account this at least one limit value, and are converted to adjusted desired tilt values, which are used to adjust a wagon body tilt system.

In order to avoid driving a tilt system, comprising an adjustment system, a wagon body and a wagon body spring system, until unacceptable conditions are reached, an adaptation of the desired tilt values takes place in accordance with the invention by means of a desired tilt value adapter, installed in series before the tilt system. A usable signal for determining the limit values and taking into account a rail camber or banking angle can presently be generated from the signals for the gyro and for acceleration sensor or sensing element. German Patent Application No. DE 1970175, which is cited above, discloses such a process for generating an adjustment signal from a sensor bundle or packet.

Advantageous further features and modifications of the basic invention are described and discussed.

The desired tilt values are determined from a sensor bundle, from line responder beacons or transponders, a GPS receiver, data or similar information recorded in a table.

The movement behavior, meaning the tilt system conditions of the wagon body as determined by its parameters such as mass inertial, moment, etc., as well as the operating behavior of the adjustment system such as spring and cylinder paths, is simulated in a computer based on these initially theoretical desired tilt values.

If limit values for comfort and/or the system describing parameters such as maximum spring or cylinder paths were to be exceeded during the realization of the tilt system conditions obtained through the simulation, these tilt system conditions are subsequently replaced by maximum permissible tilt system conditions that take into account the limit values.

A permissible, adapted desired tilt value is then obtained by calculating back from the permissible tilt system conditions with the aid of an inverse simulation. This is done by using an inverse image of the simulated tilt system in the computer.

However, the adaptation of the desired tilt values becomes active only if a predetermined limit in the online simulated model of the tilt system is addressed or reached. This means that the process according to the invention adapts (limits) the desired tilt values only if one tilt system condition, e.g. the adjusting or correcting acceleration or influencing variables of the dissatisfaction factor, is outside of the range of permissible tilt system conditions. No interference in the tilt system occurs within these tolerance ranges with respect to the preset desired value. The dynamic and capability of the tilt system are therefore used to the full extent. The desired tilt values determined in this way can be used directly for the tilting of the wagon body or indirectly, that is by a control and/or regulating system.

The acceleration and jolt in the wagon body and the rotational roll speed of the wagon body are influencing variables for the passenger dissatisfaction factor. Depending on the type of use, one of these influencing variables may be weighted for the control and/or regulation of the respective tilt system. For example, the jolt can be adjusted to be particularly low for the sleeper car, and the rotational roll speed can be adjusted to be particularly low for the dining car.

The reduction in wear and tear on the tilt system is another advantage of the desired value adaptation. In addition, the security against an operational failure of the tilt system is increased.

Once they are determined, the signals for the wagon body tilt angle are valid with a time delay for all following wagon bodies.

The invention is explained in more detail in the following with the aid of an embodiment and the drawing.

DETAILED DESCRIPTION OF THE PREFERRED EMBODIMENT

Figure 1:
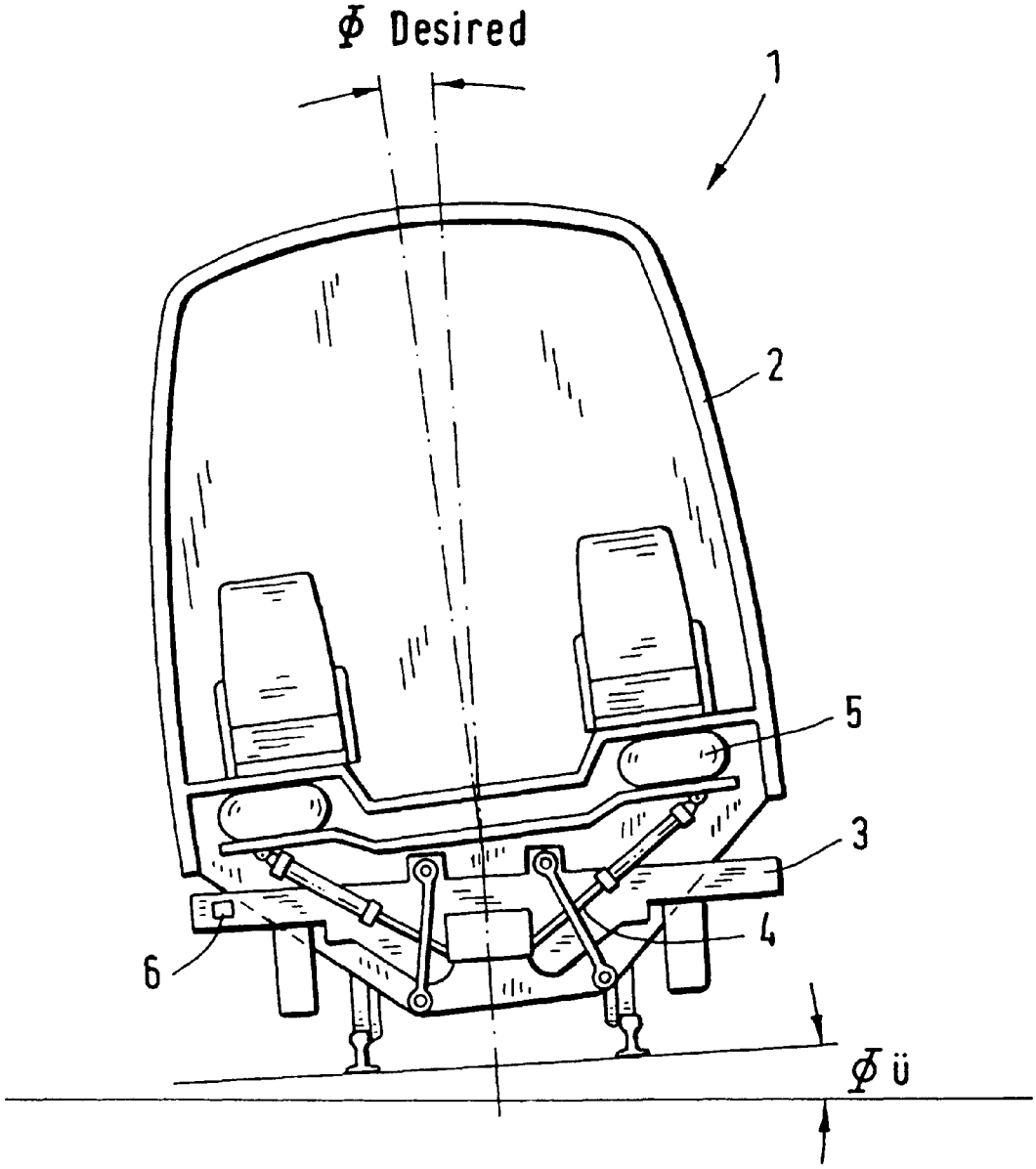
FIG. 1 is a schematic diagrammatic illustration of a wagon body with a tilt system.

FIG. 1 shows a real wagon body tilt system 1, comprising a wagon body 2, a bogie or truck 3 with adjustment system 4 and a wagon body spring system 5. A sensor bundle 6, which is arranged for a control on the bogie 3 (as shown) or for a regulation (not shown) on the wagon body spring system 5 of wagon body 2, generates desired tilt values for the real wagon body tilt system 1, e.g. a desired value for the tilt angle $\phi_{desired}$, a desired value for the tilt speed $\phi_{des.\ speed}$ and a desired value for the tilt acceleration $\phi_{des.\ acceleration}$. In this case, the desired value for the tilt speed $\phi_{des.\ speed}$ as well as the desired value for the tilt acceleration $\phi_{des.\ acceleration}$ serve to support the process.

Figure 2:
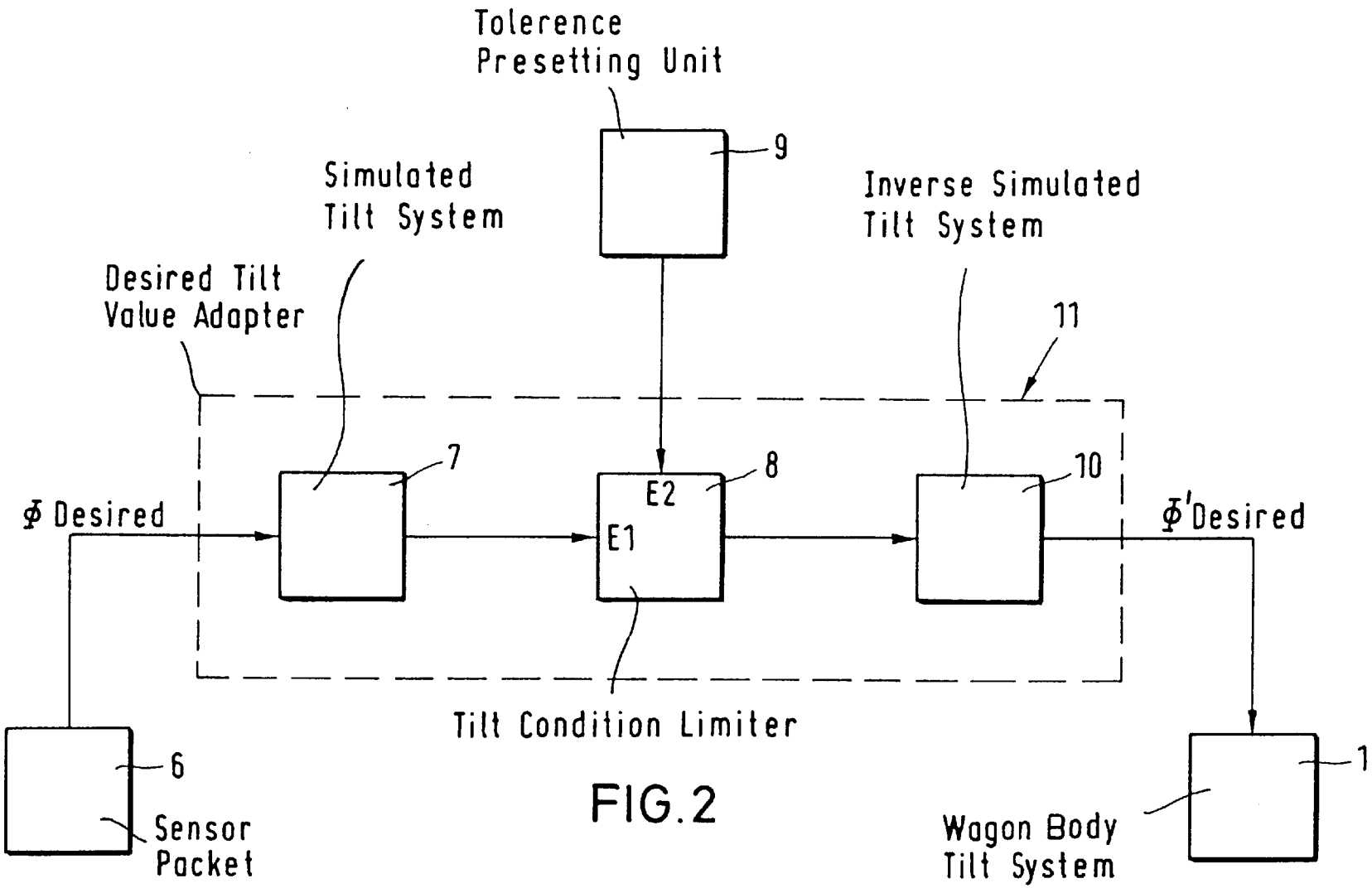
FIG. 2 is a block circuit diagram for the tilt control arrangement according to the invention for the wagon body of FIG. 1.

These desired tilt values travel to an online simulated model of a tilt system 7, shown in FIG. 2, for which the output is connected to an input E1 of a tilt condition limiter 8, whose other input F2 is connected to the output of a tolerance presetting unit 9. An inverse, simulated tilt system 10 is connected in series behind, i.e., to the output of, the tilt condition limiter 8, so that the initial desired tilt values can subsequently be made available as adapted desired tilt values for the adjustment of wagon body 2. This can occur either directly or indirectly by way of a subsequent control and/or regulation system.

Figure 3:
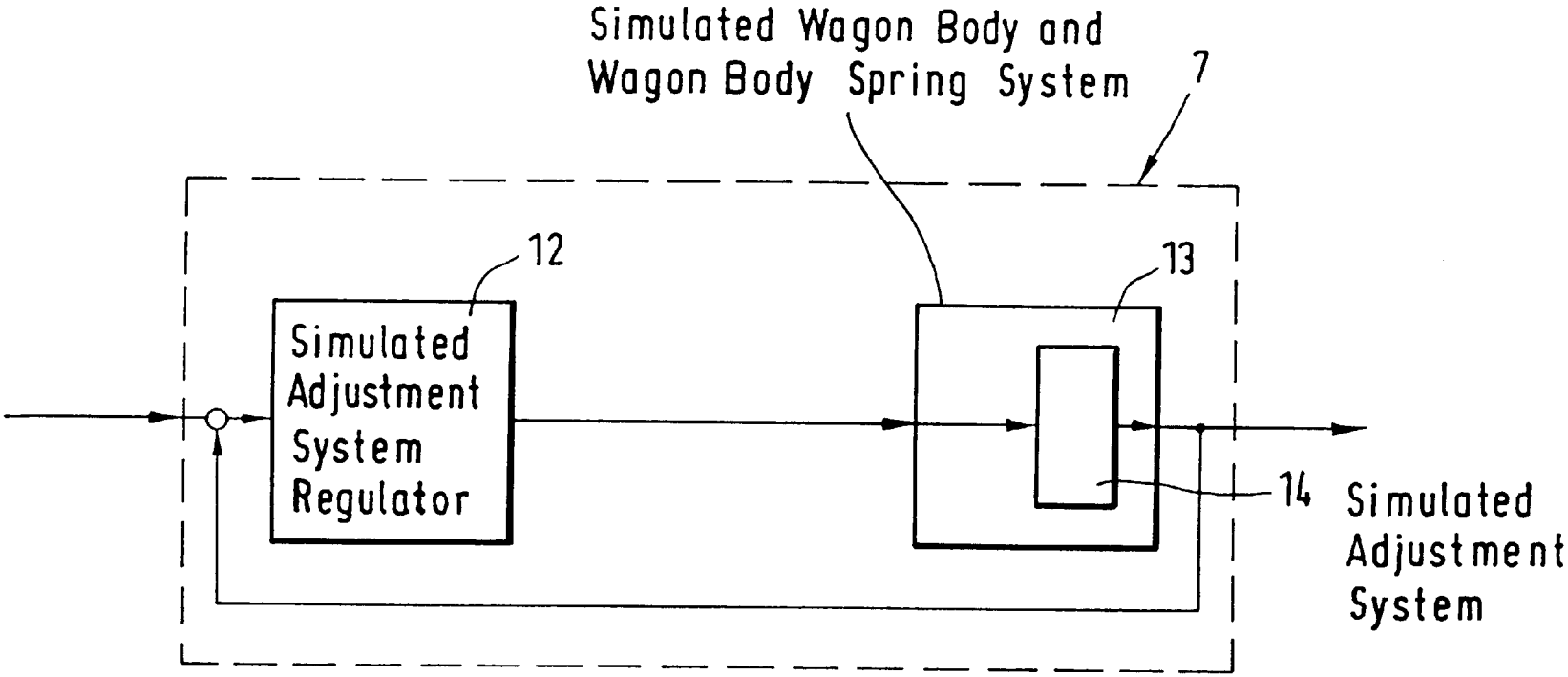
FIG. 3 is a block circuit diagram of a simulated tilt system for the control arrangement of FIG. 2.

The simulated tilt system 7, the tilt condition limiter 8, as well as the inverse, simulated tilt system 10 are here combined to form a desired tilt value adapter 11. The simulated tilt system 7 simulates the real wagon body tilt system 1 and, as shown in FIG. 3, comprises a simulated adjustment system regulator 12 as well as an equally simulated wagon body and wagon body spring system 13 and simulated adjustment system 14.

The inverse, simulated tilt system 10 is the inverse image with severe inverse components of the simulated tilt system 7. The number of inverse components utilized or provided follows from the tilt system conditions to be limited for adapting the desired tilt values.

As a result of the desired tilt value adaptation, the real wagon body tilt system 1 is not driven to unacceptable conditions (tilt system conditions) and the previously mentioned influencing variables for the dissatisfaction factor are thus taken into account.

The process proceeds as follows:

In the desired tilt value adapter 11, the generated desired tilt values $\phi_{desired}$ travel, for example, from the sensor bundle 6 as signals to the simulated tilt system 7. The simulated tilt system conditions, e.g. resulting from the tilt angle $\phi_{desired}$, are in this case, for example, the adjustment system acceleration, the kinematic deflection, the spring deformation, the tilt acceleration.

The simulated adjustment system regulator 12 performs a variance comparison between the tilt angle $\phi_{desired}$ that is to be adjusted and a simulated, momentary tilt angle $\phi_{actual}$. The signal coming from the regulator 12 travels to the simulated adjustment system 14 and simultaneously adjusts the tilt system conditions. These tilt system conditions, which are generated by the simulated adjustment system 14, are identical by approximation to the tilt system conditions of the real wagon body tilt system 1. Maximum permissible tilt system conditions are also present at the tilt condition limiter 8, which are stored in the tolerance presetting unit 9 and reflect system-describing parameters as well as comfort values.

If the tilt system conditions generated in the simulated tilt system 7 have a smaller value than the maximum permissible tilt system conditions from the tolerance presetting unit 9, then these generated signals travel through the tilt condition limiter 8 without being processed, resulting only in a comparison to determine the permissibility. The unlimited signals at the output of the tilt condition limiter 8 are then transformed back by the inverse simulated tilt system 10, which operates in an inverse mode relative to the simulated tilt system 7, so that the original tilt angle $\phi_{desired}$, for example, now is present with the same size/value as tilt angle $\phi'_{desired}$, as an output signal for the simulated inverse tilt system 10. This tilt angle $\phi'_{desired}$ is then transmitted for an adjustment of the real wagon body tilt system 1, so that a real adjustment of the real wagon body tilt system 1 takes place with the aid of the tilt angle $\phi'_{desired}$.

However, if a positive difference is determined during the comparison in the tilt condition limiter 8, that is if the signals generated in the tilt system 7 are larger than those preset by the tolerance presetting unit 9, then the tilt condition limiter 8 is activated, wherein only a maximum tilt system condition must be exceeded for the activation. As a result, the exceeded signals that are generated in the simulated tilt system 7 are then limited by the tilt condition limiter 8. In that case, the limitation occurs for each tilt system condition, so that a combination of the generated, non-limited tilt system conditions of the simulated tilt system 7 and the limited, maximum permissible tilt system conditions from the tolerance presetting unit 9 are present at the output for the tilt condition limiter 8. These limited tilt system conditions travel to the inverted, simulated tilt system 10. There, these tilt system conditions are transformed back to adapted desired tilt and $\phi'_{desired}$, $\phi'_{des.\ speed}$, $\phi'_{des.\ accel.}$ and result in upper or lower limit or adaptation lines for the desired tilt values $\phi'_{desired}$, $\phi'_{des.\ speed}$, $\phi'_{des.\ accel.}$. If, for example, three tilt system conditions are limited, this results in three adaptation lines for the desired tilt values $\phi'_{desired}$, $\phi'_{des\ speed}$, $\phi'_{des.\ accel.}$, necessitated by the fact that an inverse simulation is carried out for each limited tilt system condition and the respective adaptation line is calculated. The resulting desired tilt values, which are determined through running down the adaptation lines, cannot exceed any delimiting lines, so that no undesired tilt system condition appears/occurs.

If, for example, a permissible spring adjustment of maximum 5 cm were to be increased to 6 cm through adjusting the tilt angle $\phi'_{desired}$, owing to the fact that the desired tilt values $\phi_{desired}$, $\phi_{des.\ speed}$, $\phi_{des.\ accel.}$ do not stay within the tolerance range for the tilt system condition "permissible spring adjustment" and the resulting reference line, and only the adaptation line for the "kinematic deflection," for example, would run optimally, then the resulting spring adjustment would lead to a possible destruction of the spring along with an increase in the dissatisfaction factor.

The desired tilt values $\phi'_{desired}$, $\phi'_{des.\ speed}$, $\phi'_{des.\ accel}$ which are adapted in this way are used to adjust the real adjustment system 4 of the real wagon body tilt system 1.

In this case, the desired tilt values $\phi'_{desired}$, $\phi'_{des.\ speed}$, and $\phi'_{des.\ accel}$ are fed, for example, into a ring memory that is not shown in further detail. In accordance with the train speed v and the distances between the undercarriages, the desired tilt values are removed from the ring memory in dependence on the location and the wagon body type and are fed as control and/or regulating value to the respective adjustment systems 4 for the wagon bodies 2.

Figure 4:
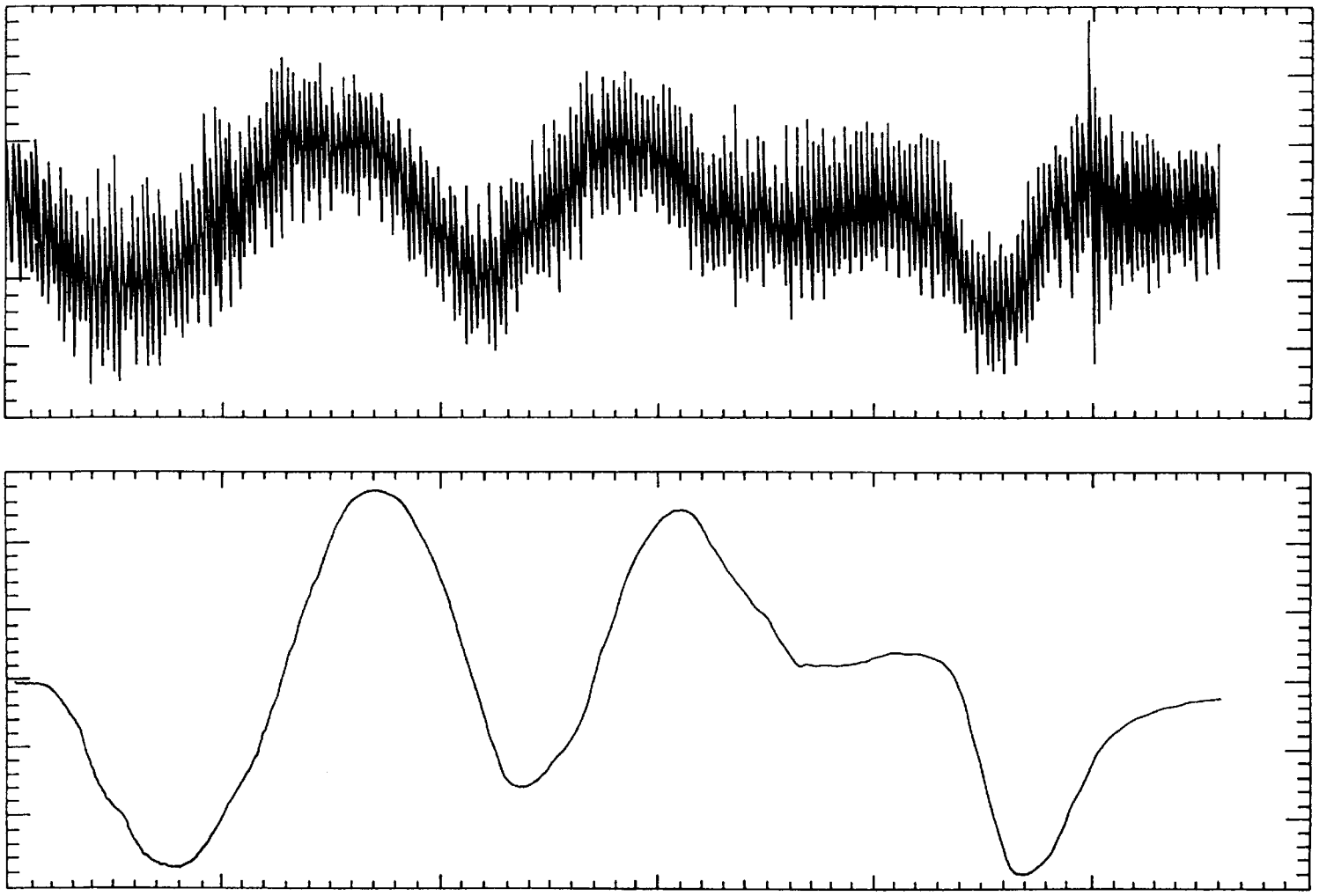
FIG. 4 is an illustration of a measured wagon body tilt angle as compared to an adapted wagon body tilt angle according to the invention over the same period of time.

FIG. 4 shows an adjusted tilt angle $\phi'_{desired}$ as compared to the generated tilt angle $\phi_{desired}$ from the sensor bundle 6. The disturbance variables acting upon and measured at the sensor bundle 6 are limited, so that the disturbance variables no longer can act upon the subsequent real wagon body tilt system 1 with real adjustment system 4 and real wagon body 2. Consequently, the real adjustment system 4 is not longer stressed by disturbance variables and the wear and tear is reduced.

As a result of the inverse online simulation of the wagon body tilt system 1 through the desired tilt value adapter 11, the desired tilt values are limited continuously, so at the redetermined maximum conditions are not exceeded. The continuity follows from the simulation of all tilt system conditions. The adapted desired tilt values are sufficient to adjust the real wagon body in such a way that even a rail camber adaptation, following the appearance of a rail camber angle $\phi_c$, is ensured quickly through avoiding delays in the filtering and thus avoiding a loss in driving comfort.

If a tilt condition is limited, then the tilt condition is also limited in the simulated tilt system 7, so that the tilt conditions in the real wagon body tilt system 1 and the simulated tilt system 7 are identical by approximation.

The maximum permissible tilt system conditions are stored as data in the tolerance presetting unit 9. The simulated tilt system 7 is shown as a physical model. Respectively, one current or relevant mathematical calculation for the sampling points (e.g., through an integral function) takes place. The calculated tilt system conditions are not stored as data. They are determined momentarily and evaluated. The inverse tilt system 10 also performs a current mathematical calculation, but one which is inverse relative to the tilt system 7. (For a mathematical integral function, the inverse calculation would be a differential function.)

It is understood that the tolerance presetting unit 9 can also be a direct component of the desired tilt value adapter 11 and like this adapter can be integrated into the system computer for the train.

If line or track data are available, the maximum tilt system conditions can be recorded in tables that also take into account the track design or construction. These path-dependent maximum tilt system conditions here are coordinated with a line or track coding, and can be consulted for the control or regulation when traveling through this particular coded section.

Owing to constant maximum values for the tilt system conditions, the process and device for the tilt control/regulation thus can be used even if no data are provided or only data for specific ranges.

These data from the tables are frequently used in place of the signal from the sensor bundle 6 or as a control for the generated signal. It is also possible to use a GPS system with receiver or to use known responder beacons for the actual location determination, wherein line or track data stored in the computer is used for this as well.

It is possible to provide for an additional rolling motion stabilization of the wagon body 2 in order to counteract movement values, e.g. side winds, which have not been taken into account. With this additional active regulation, the angle between the wagon body 2 and the adjustment system 4 is adjusted to zero degrees.

The invention now being fully described, it will be apparent to one of the ordinary skill in the art that any changes and modifications can be made thereto without departing from the spirit or scope of the invention as set forth herein.

What is claimed:

1. A process for determining tilt values for the control and/or regulation of wagon body tilt systems for a rail vehicle, comprising the steps of: providing desired tilt values for at least one tilt parameter of the vehicle; determining if, based on the provided desired tilt values, at least one limit value for a comfort parameter and parameters describing the system is exceeded; if at least one said limit value is exceeded, varying and converting the desired tilt values, taking the at least one limit value into consideration, to adapted desired tilt values to be used for the adjustment of the wagon body tilt system.

2. A process according to claim 1, the steps of determining and varying and converting comprise:

feeding the desired tilt values as theoretical desired tilt values to a computer-simulated tilt system to produce simulated tilt system conditions; replacing the simulated tilt system conditions with maximum permissible tilt system conditions where appropriate based on the limit values for comfort parameters and the parameters describing the system; and calculating these replaced tilt system conditions back to permissible, adapted desired tilt values by using an inverse simulation of the system describing the wagon body tilt system, which inverse simulation is stored in the computer.

3. A process according to claim 1, wherein the desired tilt values are determined from a condition sensor bundle mounted on the vehicle.

4. A process according to claim 1, wherein the desired tilt values are determined from track data recorded in tables.

5. A process according to claim 1 wherein the steps of determining, varying and converting include: transforming the desired tilt values through a simulated tilt system into coordinated simulated tilt system condition; comparing these simulated tilt system conditions to the maximum permissible tilt system conditions stored in a tolerance presetting unit; limiting the simulated tilt system conditions for values outside of the range for permissible tilt system conditions; and transforming the limited tilt system conditions back to corresponding adapted desired tilt values ($\phi'_{desired}$, $\phi'_{des.\ accel.}$, $\phi'_{des.\ speed}$) in a simulated tilt system using an inverse operation as compared to the simulated tilt system.

6. A process according to claim 5, further comprising using the determined, adapted desired tilt values ($\phi'_{desired}$, $\phi'_{des.\ accel}$, $\phi'_{des.\ speed}$) for all subsequent wagon body tilt systems while taking the respective wagon body type into consideration.

7. A process according to claim 1, wherein a rolling motion stabilization is additionally used.

8. A process according to claim 1, wherein the tilt system conditions contain influencing variables of a passenger dissatisfaction factor.

9. A process according to claim 1, wherein track-dependant maximum tilt conditions, which are stored in a track coding, are used in addition to the maximum permissible tilt system conditions.

10. A process according to claim 1 wherein the desired tilt values contain desired values for at least one of a tilt angle ($\phi_{desired}$), a tilt acceleration ($\phi_{des.\ accel.}$) and a tilt speed ($\phi_{des.\ speed}$).

11. The process according to claim 10 wherein the desired tilt values contain desired values for the tilt angle ($\phi_{desired}$), the tilt acceleration ($\phi_{desired\ accel.}$) and the tilt speed ($\phi_{des.\ speed}$).

12. In a device for the control and/or regulation of wagon body tilt systems for a rail vehicle with an adjustment system including sensor means, mounted on a wagon body of a rail vehicle, for providing signals corresponding to desired tilt values, and means, responsive to the sensor signals, for adjusting the tilt of the wagon body; the improvement wherein said means for adjusting includes a desired tilt value adapter, for adjusting the desired tilt values according to preset limit values, connected between the sensor means and at least one wagon body tilt system, either directly or indirectly.

13. A device according to claim 12, wherein the desired tilt value adapter comprises: a first simulated tilt system corresponding to the design of the wagon body tilt system; a tilt condition limiter having its input connected to the output of the first simulated tilt system; and, a further simulated tilt system, having an inverse design relative to the first simulated tilt system, connected in series after the tilt condition limiter.

14. A device according to claim 13, wherein the first simulated tilt system consists of a simulated adjustment system regulator whose output is fed to a simulated wagon body system.

15. A device according to claim 12, wherein a tolerance presetting unit for providing said limit values is connected to an input of the tilt condition limiter.

16. A device according to claim 15, wherein the desired value adapter and the tolerance presetting unit are integrated into a computer.

17. A device according to claim 16, wherein the sensor means comprises a sensor bundle arranged at an undercarriage for the first wagon body for a given travel direction and electrically connected to the computer.

18. A device according to claim 16, wherein a GPS receiver is connected to the computer.

* * * * *